US006619252B2

(12) United States Patent
Haas et al.

(10) Patent No.: US 6,619,252 B2
(45) Date of Patent: Sep. 16, 2003

(54) SWITCHABLE TAPPET FOR THE DIRECT TRANSMISSION OF A CAM LIFT TO A TAPPET PUSH ROD

(75) Inventors: Michael Haas, Weisendorf (DE); Henning Karbstein, Strullendorf (DE); Martin Rauch, Bamberg (DE); Dieter Schmidt, Nuremberg (DE)

(73) Assignee: INA-Schaeffler KG (DE)

( * ) Notice: Subject to any disclaimer, the term of this patent is extended or adjusted under 35 U.S.C. 154(b) by 0 days.

(21) Appl. No.: 10/093,015

(22) Filed: Mar. 7, 2002

(65) Prior Publication Data

US 2002/0134338 A1 Sep. 26, 2002

Related U.S. Application Data

(60) Provisional application No. 60/274,472, filed on Mar. 8, 2001.

(51) Int. Cl.[7] ..... F01L 1/14

(52) U.S. Cl. ..... 123/90.52; 123/90.48; 123/90.55; 123/90.57

(58) Field of Search ..... 123/90.48, 90.49, 123/90.5, 90.51, 90.52, 90.53, 90.54, 90.55, 90.56, 90.57, 90.58, 90.59

(56) References Cited

U.S. PATENT DOCUMENTS

| | | | | |
|---|---|---|---|---|
| 3,385,274 A | * | 5/1968 | Shunta et al. | 123/90.16 |
| 3,406,668 A | * | 10/1968 | Donnelly et al. | 123/90.56 |
| 4,133,332 A | * | 1/1979 | Benson et al. | 123/198 F |
| 4,407,241 A | * | 10/1983 | Butler et al. | 123/90.16 |
| 5,241,927 A | * | 9/1993 | Rhoads | 123/90.16 |

* cited by examiner

*Primary Examiner*—Thomas Denion
*Assistant Examiner*—Jaime Corrigan
(74) *Attorney, Agent, or Firm*—Muserlian, Lucas and Mercanti

(57) ABSTRACT

What is proposed is a switchable tappet (1) for the direct transmission of a cam lift to a tappet push rod. The tappet (1) comprises a hydraulic clearance compensation element (31) and has an excellent hydraulic rigidity compared to the prior art. This is achieved by a leak gap positioned radially very far outwards. This leak gap is situated directly between a housing (2) and a pressure piston (4) which, in its turn, encloses an inner element (11) that acts on a tappet push rod.

9 Claims, 1 Drawing Sheet

SWITCHABLE TAPPET FOR THE DIRECT TRANSMISSION OF A CAM LIFT TO A TAPPET PUSH ROD

PRIOR APPLICATION

This application is based on provisional patent application Ser. No. 60/274,472 filed Mar. 8, 2001.

FIELD OF THE INVENTION

The invention concerns a switchable tappet for a direct transmission of a cam lift to a tappet push rod in a valve train of an internal combustion engine, said tappet comprising a housing in whose axially extending cavity a longitudinally displaceable inner element is arranged that can be connected at least indirectly to the housing in a relative position to the housing by a coupling means, which housing comprises on an end facing away from the cavity, a contact surface for a cam, and which inner element comprises on a side of the cavity, a support for the tappet push rod while being biased away from the housing by at least one coiled compression spring, a hydraulic clearance compensation element comprising a pressure piston being installed in the tappet, which pressure piston defines on one end, a high pressure chamber, on an outer peripheral surface, a leak gap and with a bore, a reservoir for hydraulic medium.

BACKGROUND OF THE INVENTION

A tappet of the pre-cited type is disclosed in DE 198 44 202 which is considered to be generic art. Due to the overlapping arrangement of a pressure piston of a hydraulic clearance compensation element in an inner element, which, in turn, extends in a housing, a leak gap from a high pressure chamber is formed axially below the pressure piston, which leak gap has an inadequate size because it is formed on a relatively small diameter. As a result, the hydraulic rigidity of the tappet is too low. In addition, it will be remarked that due to the arrangement of a coiled compression spring, also called a lost motion spring, in the interior, the overall length of the housing of the tappet is unnecessarily increased. Thus, this tappet has an unfavorable, large mass.

OBJECTS OF THE INVENTION

It is an object of the invention to provide a tappet of the pre-cited type in which the aforesaid drawbacks are eliminated by simple measures.

This and other objects and advantages of the invention will become obvious from the following detailed description.

SUMMARY OF THE INVENTION

The invention achieves the above objects by the fact that the pressure piston is installed directly in the cavity of the housing, and the high pressure chamber is formed directly between an end of the pressure piston and the closed opposite end of the housing, the inner element extending directly in the bore of the pressure piston.

Due to the fact that the leak gap is shifted outwards as compared to the initially cited prior art, this leak gap is relatively large. The hydraulic rigidity of the tappet is thus markedly improved.

According to an important feature of the invention, an extension of the inner element projects beyond the cavity of the housing, and a coiled compression spring is arranged at least substantially around the extension while acting at one end on a support of the extension facing away from the reception, and at another end, on an edge or an edge-proximate section of the pressure piston or the housing.

Due to this shifting of the coiled compression spring to the outside of the housing, the height of this spring, that may also be a coiled compression spring assembly, is minimized. Thus, it is possible to replace relatively heavy housing sections with thin-walled components (extension of the inner element). In addition to the coiled compression spring arranged around the extension, if desired, a further coiled compression spring or another spring element can be arranged in the reservoir inside the pressure piston to enhance the action of the first-mentioned coiled compression spring. However, depending on the particular circumstances, it is also possible to use only one of the aforesaid coiled compression springs.

The support of the one end of the coiled compression spring around the extension of the inner element may have a one-piece or a multi-piece configuration. To mention just a few possibilities, this support may take the form of separate rings or locking rings or be made as a collar formed integrally on the extension. The support of the other end of the coiled compression spring is realized in a simple manner in that this spring is supported on an edge of the pressure piston or the housing.

As a coupling means, it is possible to use slides that, in an advantageous embodiment of the invention, are disposed in a radial web of the inner element and can be displaced radially outwards (in coupling direction) by the force of a compression spring, and radially inwards (in uncoupling direction), by hydraulic medium pressure. This radial web delimits in a simple manner with its underside, in a direction away from the high pressure chamber, a hydraulic medium reservoir that is enclosed by the pressure piston.

According to a simple measure of the invention for routing hydraulic medium to the clearance compensation element, the inner element, also for weight-saving reasons, has a hollow cylindrical configuration and, as viewed in the direction of flow, the support for the tappet push rod in the inner element has at least one opening through which the hydraulic medium can be transferred. Further, at least one passage is formed between a flank of the radial web and an inner peripheral surface of the inner element, through which passage, the hydraulic medium can be routed around the coupling means and further into the reservoir that is substantially enclosed by the pressure piston.

To prevent unnecessary splashing losses and the like in the uncoupled state of the inner element from the housing when the inner element sinks, at least one bridge member or a similar component having an opening for allowing the entry of hydraulic medium is arranged in the reservoir and limits the inner element in a direction towards the radial web. This bridge member can also have the function of an anti-leak device in inclined positions of the tappet.

According to another proposition of the invention, the extension for the coiled compression spring on the inner element is made of a light-weight material like sheet metal. If desired, this extension can also be made as a separate component and be connected to the inner element by appropriate connecting measures such as clipping, gluing, soldering or welding.

Finally, a particularly low-friction cam contact on the tappet is obtained if its contact surface is configured as a rotary roller that is advantageously mounted on the housing through a pin that may be supported on a rolling bearing if desired.

BRIEF DESCRIPTION OF THE DRAWINGS

The invention will now be described with reference to the attached drawings in which.

DETAILED DESCRIPTION OF THE DRAWINGS

Figure 1:
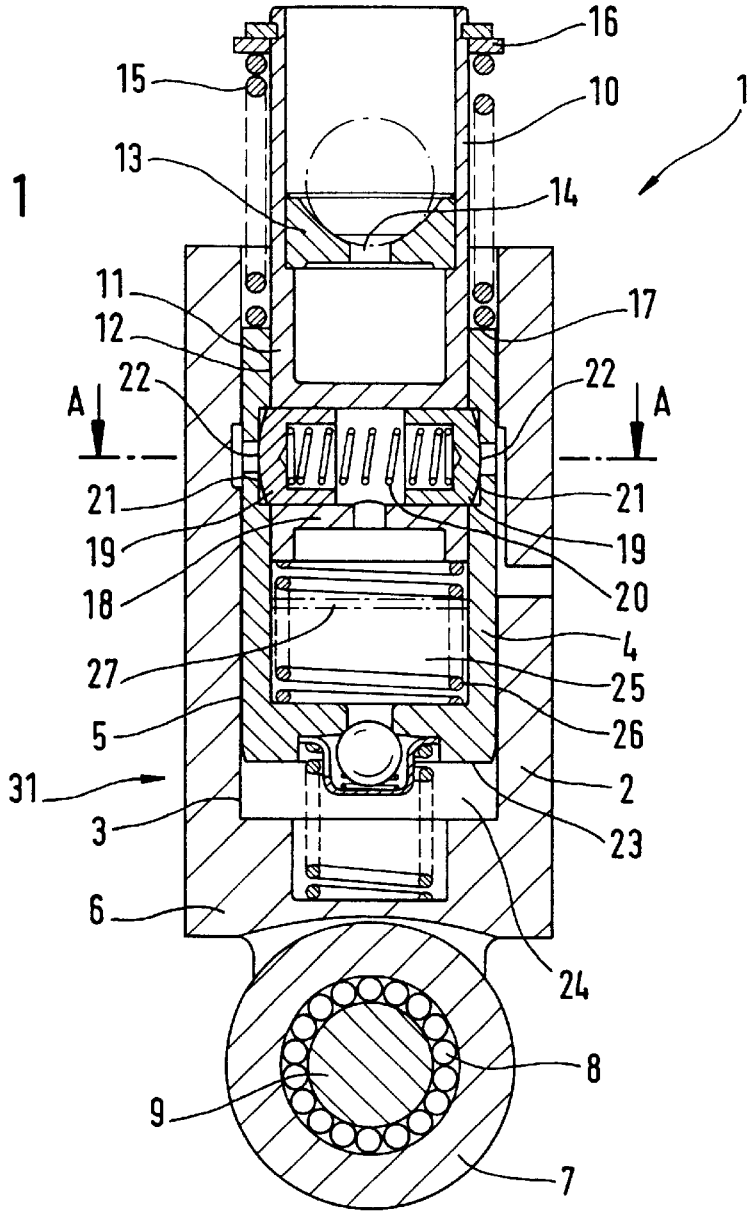
FIG. 1 is a longitudinal section through a tappet of the invention.

FIG. 1 discloses a switchable tappet 1 for the direct transmission of a cam lift to a tappet push rod. The tappet is designed to be switched on and off and comprises a housing 2 in whose cavity 3 a pressure piston 4 extends with its outer peripheral surface 5. A leak gap for hydraulic medium is formed between the cavity 3 and the outer peripheral surface 5.

An end 6 of the housing 2 facing away from the cavity 3 has a closed configuration and comprises a contact surface 7 for a cam. The contact surface 7 is configured as a roller that is guided through a rolling bearing 8 on a pin 9. The pin 9, in turn, is mounted at its ends in the housing 2.

An extension 10 projects beyond an opening of the cavity 3 facing away from the end 6. In the present embodiment, the extension 10 has a thin-walled, hollow cylindrical configuration and is formed integrally on the inner element 11. However, it is both conceivable and within the scope of the invention to use a two-piece configuration in which, as mentioned above, the extension 10 is coupled to the inner element 11, for example, by a clip connection. The inner element 11 extends in a bore 12 of the pressure piston 4 and is axially displaceable relative thereto. The inner element 11 comprises a support 13 for a tappet push rod, not shown, said support 13 possessing an opening 14 for transmitting hydraulic medium into the interior of the tappet.

Although not specifically identified in the drawing, it is possible to provide the inner element 11 with an end stop or displacement limiting means in a direction oriented away from the housing. In this way, a falling-apart of the components can be prevented and an exact positioning of the coupling means 19, described below, relative to their reception 21 can be assured. The end stop can be in the form of a radially protruding means such as pins, rings or spring-and-groove connections and the like which cooperate, for example, with an edge of the housing 2 or of the pressure piston 4.

A person skilled in the art will further recognize in FIG. 1 that the extension 10 is surrounded by a coiled compression spring 15. This is mounted at one end on a support 16 opposite from the end 6 while being positioned at the other end on an edge 17 of the pressure piston 4.

In its region situated within the pressure piston 4, the inner element 11 comprises a radial web 18 in which a coupling means 19 in the form of two opposing pistons is arranged. These pistons are biased radially outwards by the force of a spring element 20. In the coupled state shown in the drawing, the pistons forming the coupling means 19 extend partially in corresponding receptions 21 in the pressure piston 4. A radial inward displacement of the coupling means 19 for uncoupling the inner element 11 from the housing 2 is effected through hydraulic medium which can be routed to end faces 22 of the coupling means 19.

A high pressure chamber 24 for hydraulic medium is formed axially between the end 6 of the housing 2 and an opposing end 23 of the pressure piston 4. The aforesaid leak gap for hydraulic medium extends between the outer peripheral surface 5 of the pressure piston 4 and the cavity 3 of the housing 2 axially upwards from this high pressure chamber 24. Due to its largest possible radially outward shifting, this leak gap is relatively large, and this has a positive effect on the hydraulic rigidity of the entire tappet 1.

At the same time, due to the arrangement of the coiled compression spring 15 around the extension 10, the housing 2 is shortened, and this advantageously reduces the total mass of the tappet 1.

Above its end 23, the pressure piston 4 encloses a reservoir 25 for hydraulic medium. In axially upward direction, this reservoir 25 is delimited by an underside of the radial web 18. It can be seen that another coiled compression spring 26 is arranged in the reservoir 25. This spring 26 enhances the action of the coiled compression spring 15. Depending on the circumstances, the coiled compression spring 26 can be omitted. Further, a bridge member 27 extending across the reservoir 25 is roughly indicated in the drawing. In the final analysis, it is below this bridge member 27, that comprises at least one passage for hydraulic medium, that the hydraulic medium is accumulated. Thus, in its uncoupled state from the housing 2, the inner element 11 can no longer undesirably cause splashing in the reservoir 25. The bridge member 27 is arranged so that it is not contacted by the inner element 11 when this sinks.

Figure 2:
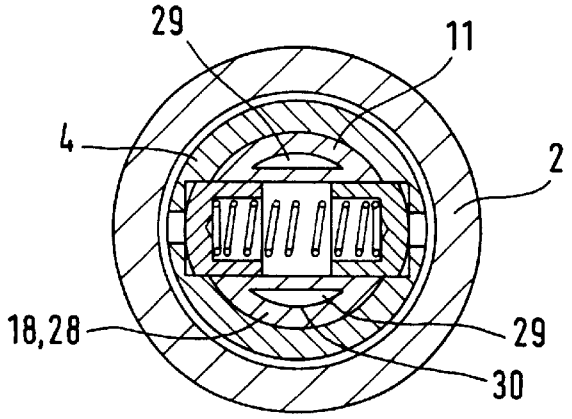
FIG. 2 is a sectional view through the coupling means of the tappet taken along the section line A—A of FIG. 1.

FIG. 2: an unobstructed transfer of the hydraulic medium available at the opening 14 of the support 13 to the reservoir 25 is assured by the fact that in the region of each of its flanks 28, the radial web 18 comprises a passage 29 that is delimited by the inner peripheral surface 30 of the inner element 11. In this way, the hydraulic medium is routed around the coupling means 19 towards the reservoir 25. It is also conceivable to provide a common supply of hydraulic medium to the hydraulic clearance compensation element 31 in the tappet 1 and the coupling means 19.

What is claimed is:

1. A switchable tappet for a direct transmission of a cam lift to a tappet push rod in a valve train of an internal combustion engine, said tappet comprising a housing in whose axially extending cavity a longitudinally displaceable inner element is arranged that can be connected at least indirectly to the housing in a relative position to the housing by a coupling means, which housing comprises on an end facing away from the cavity, a contact surface for a cam, and which inner element comprises on the side of the cavity, a support for the tappet push rod while being biased away from the housing by at least one coiled compression spring, a hydraulic clearance compensation element comprising a pressure piston being installed in the tappet, which pressure piston defines on one end, a high pressure chamber, on an outer peripheral surface, a leak gap and with a bore, a reservoir for hydraulic medium, characterized in that an extension of the inner element projects beyond the cavity of the housing, and a coiled compression spring is arranged at least substantially around the extension and acts at one end on a support of the extension facing away from the cavity, and at another end, on an edge or an edge-proximate section of the pressure piston or of the housing, or is supported on the housing.

2. A switchable tappet for a direct transmission of a cam lift to a tappet push rod in a valve train of an internal combustion engine, said tappet comprising a housing in whose axially extending cavity a longitudinally displaceable inner element is arranged that can be connected at least indirectly to the housing in a relative position to the housing by a coupling means, which housing comprises on an end facing away from the cavity, a contact surface for a cam, and which inner element comprises on the side of the cavity, a support for the tappet push rod while being biased away from the housing by at least one coiled compression spring, a hydraulic clearance compensation element comprising a pressure piston being installed in the tappet, which pressure piston defines on one end, a high pressure chamber, on an outer peripheral surface, a leak gap and with a bore, a reservoir for hydraulic medium, characterized in that the pressure piston is installed directly in the cavity of the housing, and the high pressure chamber is formed directly between said one end of the pressure piston and said end of the housing facing away foRm the cavity, which end has a closed configuration, and the inner element extends directly in the bore of the pressure piston, and an extension of the inner element projects beyond the cavity of the housing, and a coiled compression spring is arranged at least substantially around the extention and acts at one end on a support of the extention facing away from the cavity, and at another end, on an edge or an edge-proximate section of the pressure piston or of the housing, or is supported on the housing.

3. A tappet of claim 1, wherein the coupling means is configured as at least one slide that, in an uncoupled state of the inner element from the housing, extends in a radial web of the inner element, and for an coupled state, the coupling means is displaceable partially in a radially outward fore-positioned reception of the pressure piston.

4. A tappet of claim 3, wherein the inner element is hollow-cylindrical in shape and comprises at least one axially extending passage for hydraulic medium, which passage is formed radially between a flank of the radial web and an inner peripheral surface of the inner element and communicates at an inlet end with an opening in a support on the inner element and leads at an outlet end into the reservoir in the pressure piston, which reservoir is delimited in a direction away from the end of the pressure piston by the radial web.

5. A tappet of claim 4, wherein in a direction towards the radial web, the reservoir is delimited by a thin-walled bridge having at least one opening.

6. A tappet of claim 1, wherein a coiled compression spring is installed in the reservoir and bears at one end against the end of the pressure piston while acting at another end on the inner element.

7. A tappet of claim 1, wherein the extension is made of thin-walled light-weight material.

8. A tappet of claim 7, wherein the light-weight material is sheet metal.

9. A tappet of claim 1, wherein the contact surface for the cam is made as a rotary roller that is mounted on the housing through a pin.

* * * * *